US007283024B2

(12) United States Patent
Bar et al.

(10) Patent No.: US 7,283,024 B2
(45) Date of Patent: Oct. 16, 2007

(54) MEMS SWITCH STOPPER BUMPS WITH ADJUSTABLE HEIGHT

(75) Inventors: Hanan Bar, Jerusalem (IL); John Heck, Palo Alto, CA (US)

(73) Assignee: Intel Corporation, Santa Clara, CA (US)

( * ) Notice: Subject to any disclaimer, the term of this patent is extended or adjusted under 35 U.S.C. 154(b) by 299 days.

(21) Appl. No.: 10/740,649

(22) Filed: Dec. 18, 2003

(65) Prior Publication Data

US 2005/0134413 A1 Jun. 23, 2005

(51) Int. Cl.
*H01H 51/22* (2006.01)

(52) U.S. Cl. ..... 335/78; 200/181

(58) Field of Classification Search ..... 335/78; 200/181

See application file for complete search history.

(56) References Cited

U.S. PATENT DOCUMENTS

| | | | | |
|---|---|---|---|---|
| 6,054,659 | A * | 4/2000 | Lee et al. | 200/181 |
| 6,307,169 | B1 * | 10/2001 | Sun et al. | 200/181 |
| 6,331,257 | B1 * | 12/2001 | Loo et al. | 216/13 |
| 2003/0058069 | A1 * | 3/2003 | Schwartz et al. | 335/78 |
| 2003/0116417 | A1 * | 6/2003 | DeReus | 200/181 |

* cited by examiner

*Primary Examiner*—Elvin Enad
*Assistant Examiner*—Bernard Rojas
(74) *Attorney, Agent, or Firm*—Kevin A. Reif

(57) ABSTRACT

In a Micro Electro-Mechanical System (MEMS) switch, a common switch failure is a short between the upper and the lower electrostatic actuation plates. Such shorts may occur due to torque deformation. Stopper bumps having a slightly lower height profile than that of the contact bumps are provided to prevent such shorts. The stopper bumps may be made using the same mask as that used to create the contact bump with the height of the respective bumps controlled by determining the diameter of the bumps.

17 Claims, 7 Drawing Sheets

MEMS SWITCH STOPPER BUMPS WITH ADJUSTABLE HEIGHT

FIELD OF THE INVENTION

Embodiments of the present invention relate to Micro Electro-Mechanical Systems (MEMS) switches and, more particularly, to MEMS with adjustable height solder bumps.

BACKGROUND INFORMATION

There are many applications which require fast switching speeds. For example, for multi-mode multi-band cell phone applications such as GSM (Global System for Mobile Communications), GPRS (General Packet Radio Service), and 3G (Third Generation Wireless), the antenna switch unit switches the antenna to different bands as well as between transmission (TX) and receiving (RX) modes. Currently, solid-state switches are used for this purpose. While RF (Radio Frequency) MEMS metal contact series switches generally have much better insertion loss and isolation characteristics, they are much slower than solid-state switches.

Referring to FIGS. 1 and 2, these figures illustrate a top view and a side view of a MEMS in-line cantilever beam metal contact series switch, respectively. This type of MEMs switch can be manufactured by well known MEMS fabrication processes.

As shown, the switch is formed on a substrate 100 having an isolation layer 101. A metalized signal line 102 may be formed on one side of the substrate 100 and a second signal line 104 may be formed on the second side of the substrate 100 over the isolation layer 101. A cantilevered beam 106 may be secured to the second signal line 104 with an anchor 103. A bump (electrode) 108 may be formed for example by a field oxide (FOX) technique under the first signal line 102. A lower electrostatic actuation plate 110 may be formed on the substrate 100 beneath an upper electrostatic actuation plate 111 formed in the cantilevered beam 106. When the actuation plate 110 is energized, by applying a voltage, the upper actuation plate 111, and thus the cantilevered beam 106, is pulled downward causing the bump 108 with the first signal line 102 to make contact with the cantilevered beam 106. This closes the switch and provides an electrical signal path between the first signal line 102 and the second signal line 104.

Referring to FIG. 3, the most common switch failure is a short between the upper 111 and the lower electrostatic plates 110. Such shorts can occur due to deformation of the upper beam 106. The most common deformation is typically due to torque that creates short between the corner of the upper electrode 111 and the lower electrode 110. As shown in FIG. 3, the corner of the upper electrode exhibits signs of torque related shorts 120.

DETAILED DESCRIPTION

Figure 1:
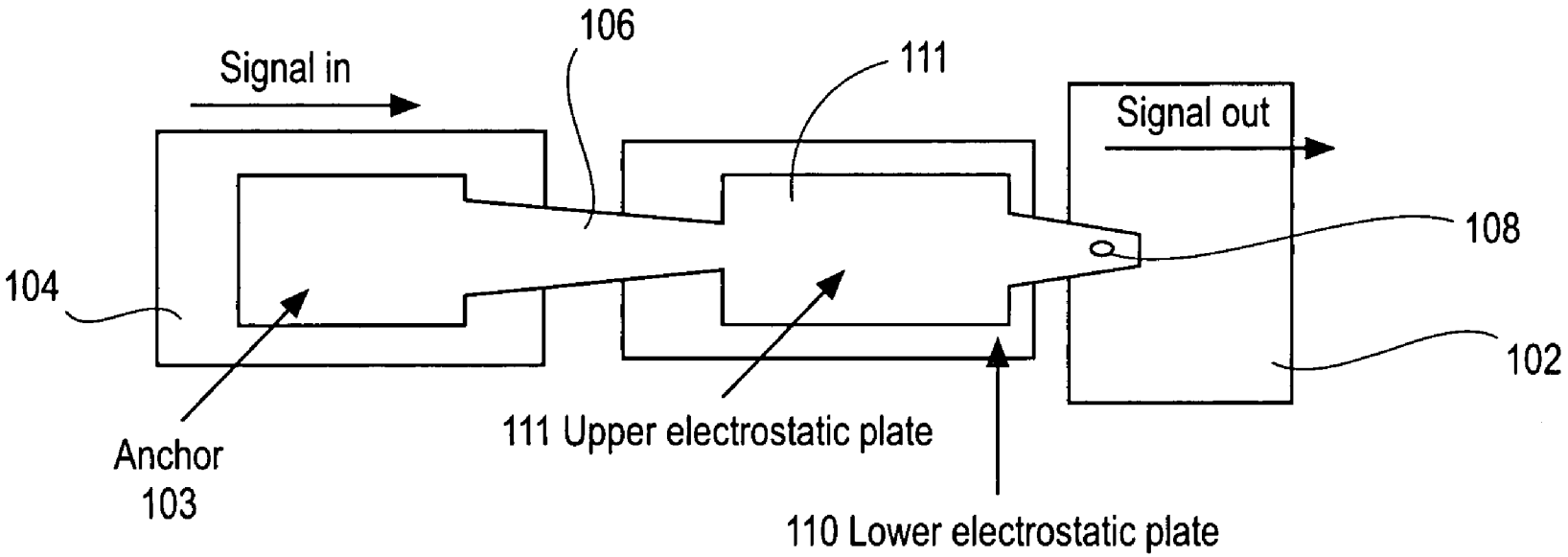
FIG. 1 is a top view of a MEMS switch.
Figure 2:
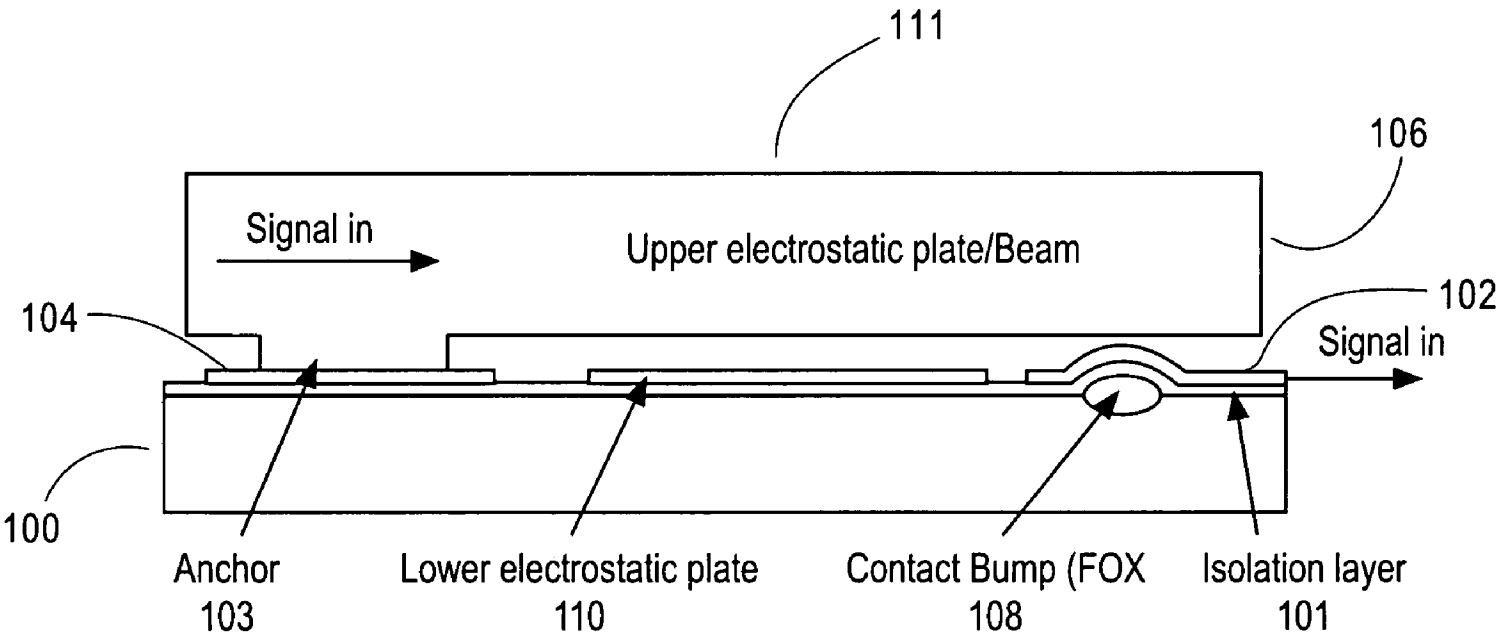
FIG. 2 is a side view of a MEMS switch.
Figure 3:
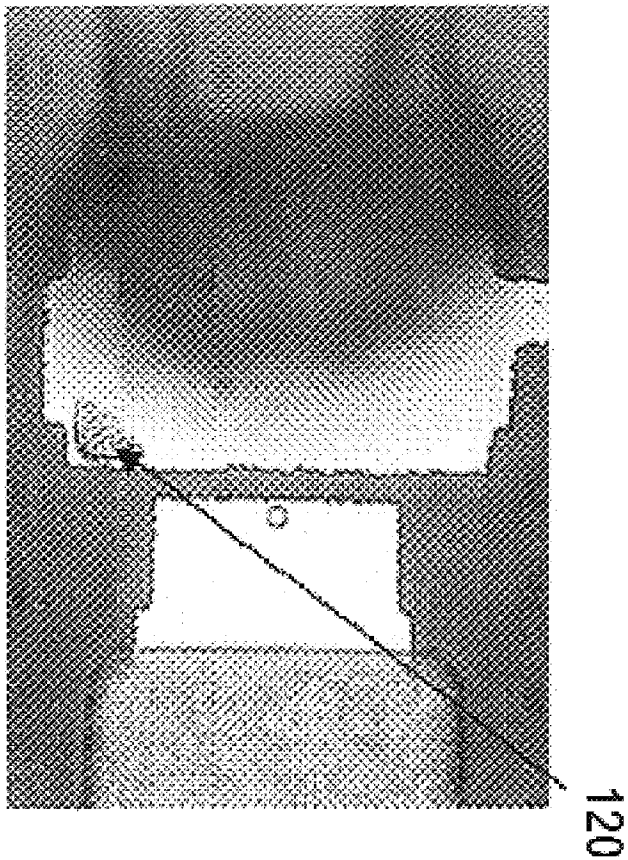
FIG. 3 is a view of a MEMS switch showing torque damage of the upper activation plate leading to an electrical short.
Figure 4:
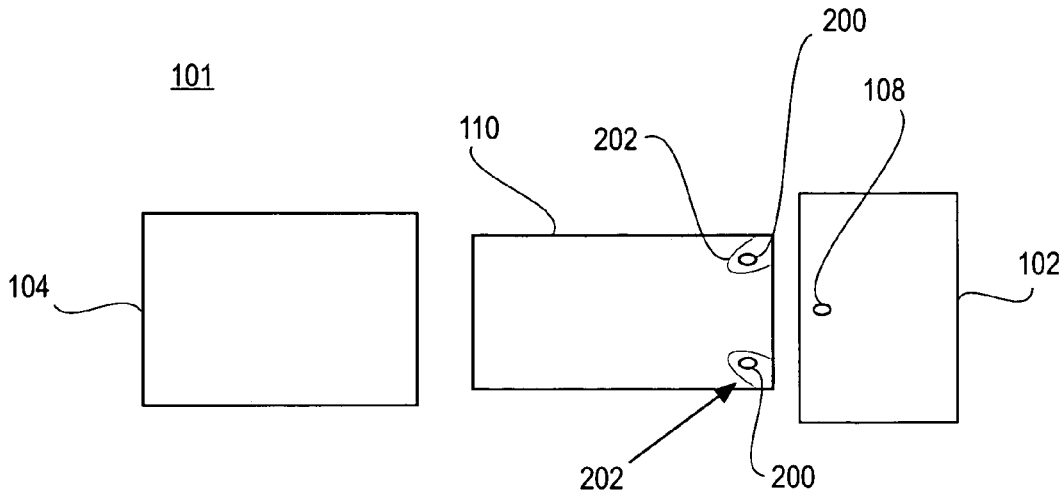
FIG. 4 is a top view of the bottom portion of the MEMS switch including the stopper bumps.
Figure 5:
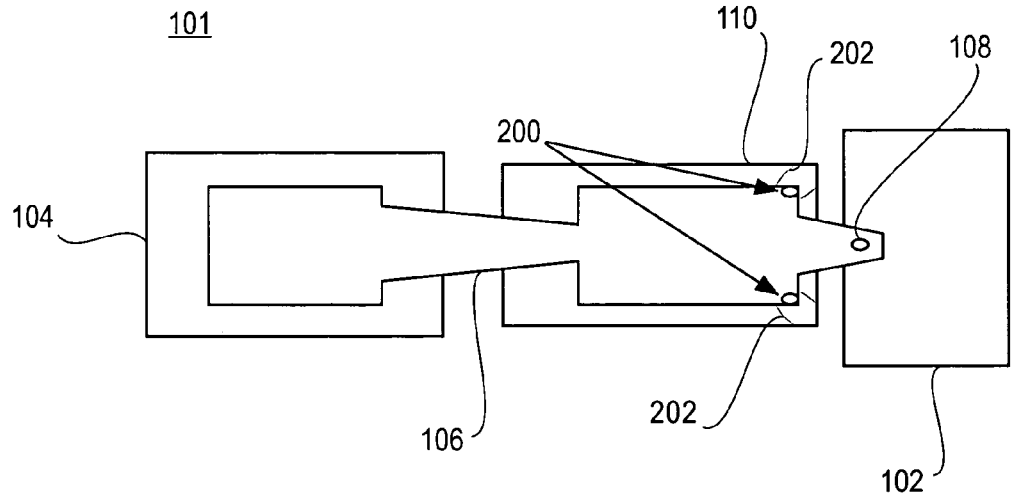
FIG. 5 is a top view of the MEMS switch including the cantilevered beam.
Figure 6:
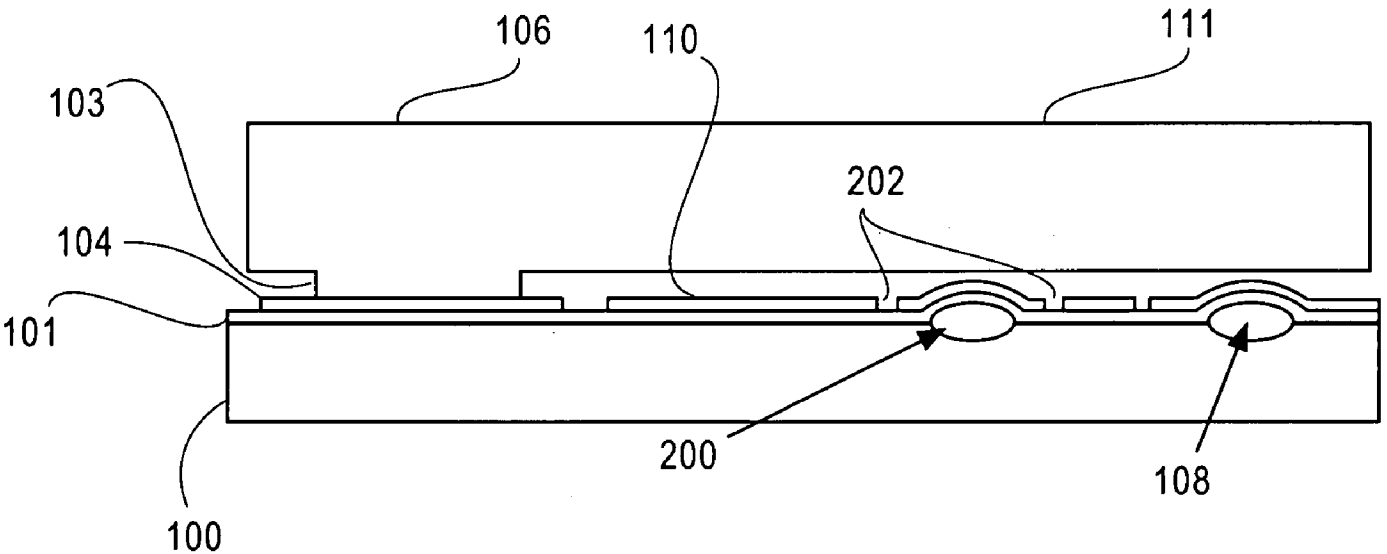
FIG. 6 is a cross sectional side view of the MEM switch illustrating the stopper bumps.

Referring now to FIGS. 4–6, there is shown one embodiment of the invention. As previously discussed, the switch is formed on a substrate 100 having an isolation layer 101. A metalized signal line 102 may be formed on one side of the substrate 100 and a second signal line 104 may be formed on the second side of the substrate 100 over the isolation layer 101. A cantilevered beam 106 may be secured to the second signal line 104 with an anchor 103. A bump (electrode) 108 may be formed for example by a field oxide (FOX) technique under the first signal line 102. A lower electrostatic actuation plate 110 may be formed on the substrate 100 beneath an upper electrostatic actuation plate 111 formed in the cantilevered beam 106.

In order to prevent shorts due, for example to torque, a stopper bump or bumps 200 are created. The stopper bump 200 may be created by addition of oxidation bumps in the bump mask, in a like manner as the contact bump 108. An isolation groove 202 is formed in the actuation plate 110 so that a short is not created even if the upper actuation plate makes contact with the stopper bump 200. Thus, there is no need for additional mask in the formation process.

As shown in FIGS. 5 and 6, when stopper bumps 200 are added at the front corners of the bottom electrostatic actuation plate 110 to prevent torque shorts, the stopper bumps 200 should have a slightly lower profile than the contact bump 108. This ensures a good electrical contact at the contact bump 108. The stopper bump height can be precisely engineered by control of the stopper bump 200 diameter.

Figure 7:
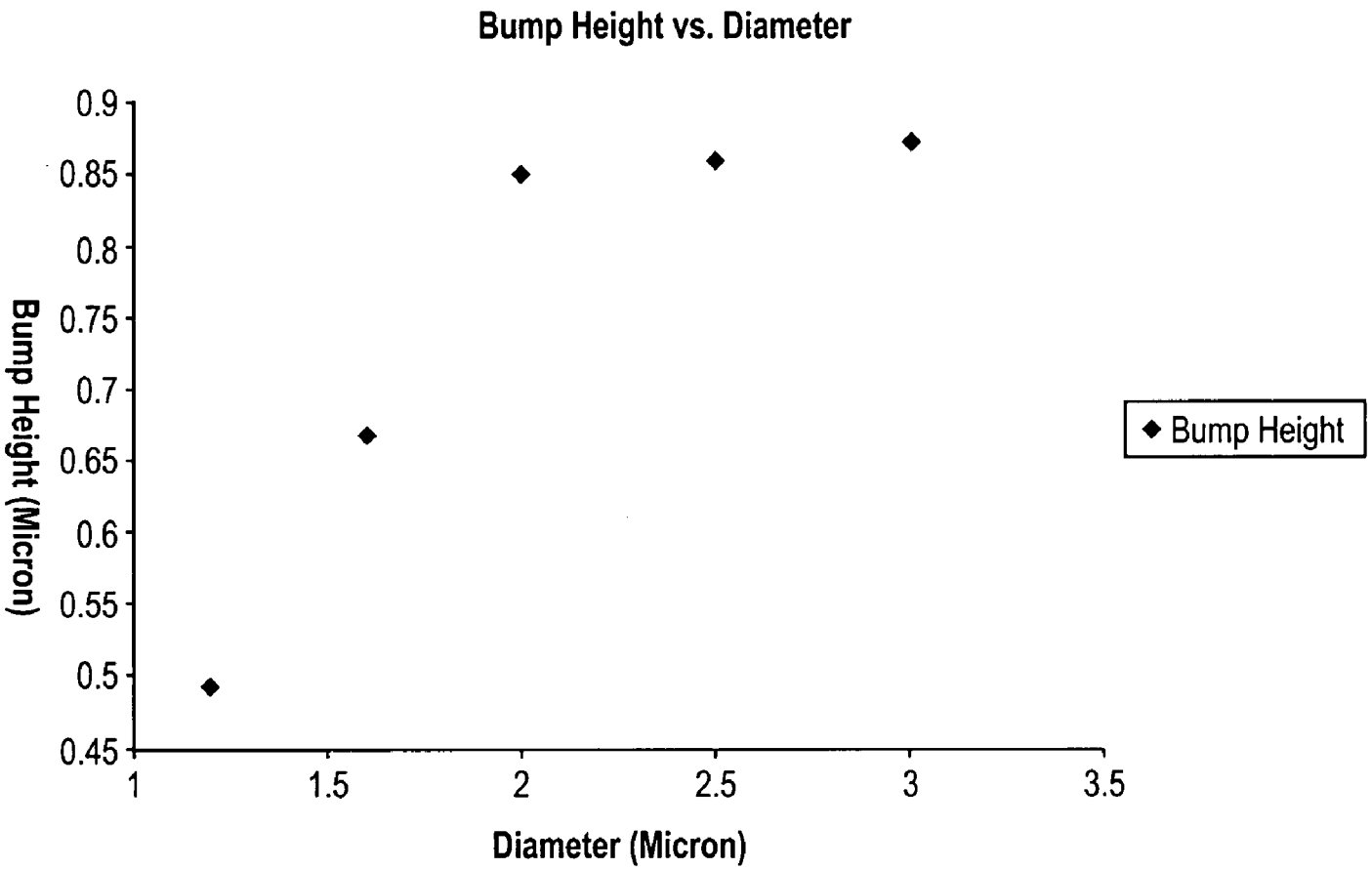
FIG. 7 is a graph illustrating bump height vs. bump diameter.

FIG. 7 shows a graph illustrating the relationship between bump 200 diameter the bump height. As illustrated wider bumps generally result in greater bump height profiles, particularly for diameters less than 2 microns. For example, for a bump diameter of about 1.2 microns, the bump height is about 0.5 microns. For a bump diameter of about 1.6 microns, the bump height is about 0.7 microns in height. Above 2 microns in bump diameter, there is a less dramatic change in bump height. Thus, by controlling the bump diameters, the stopper bumps 200 may be made shorter than the contact bump 108 to ensure a good electrical connection with the contact bump when the MEMS switch is closed.

Figure 8:
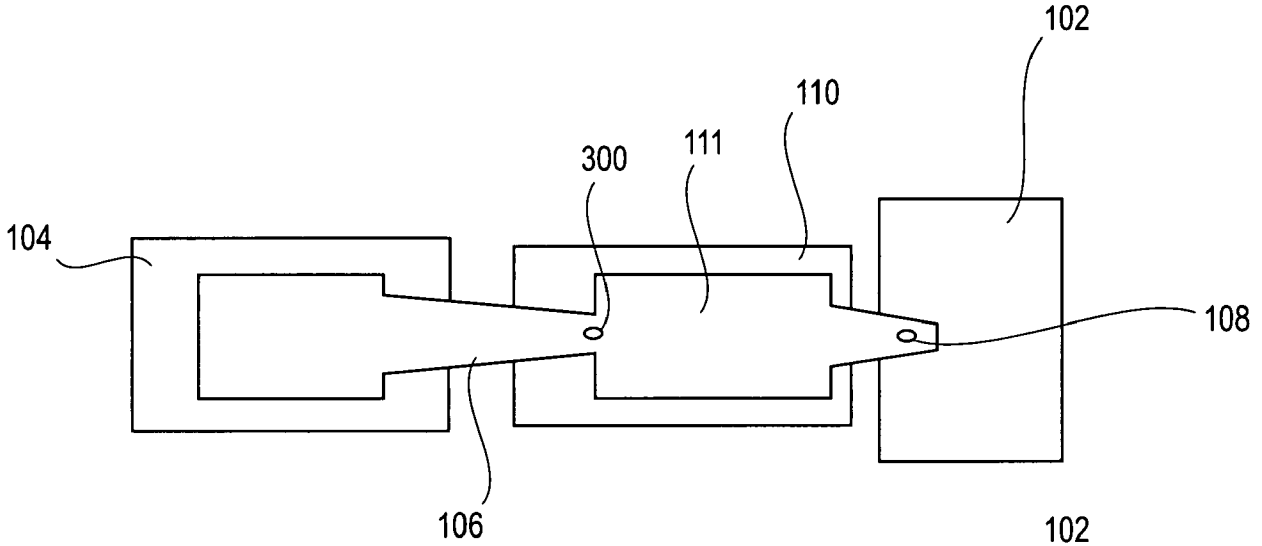
FIG. 8 is a top view of a MEMS switch showing the stopper bump located at the rear of the actuation plate.
Figure 9:
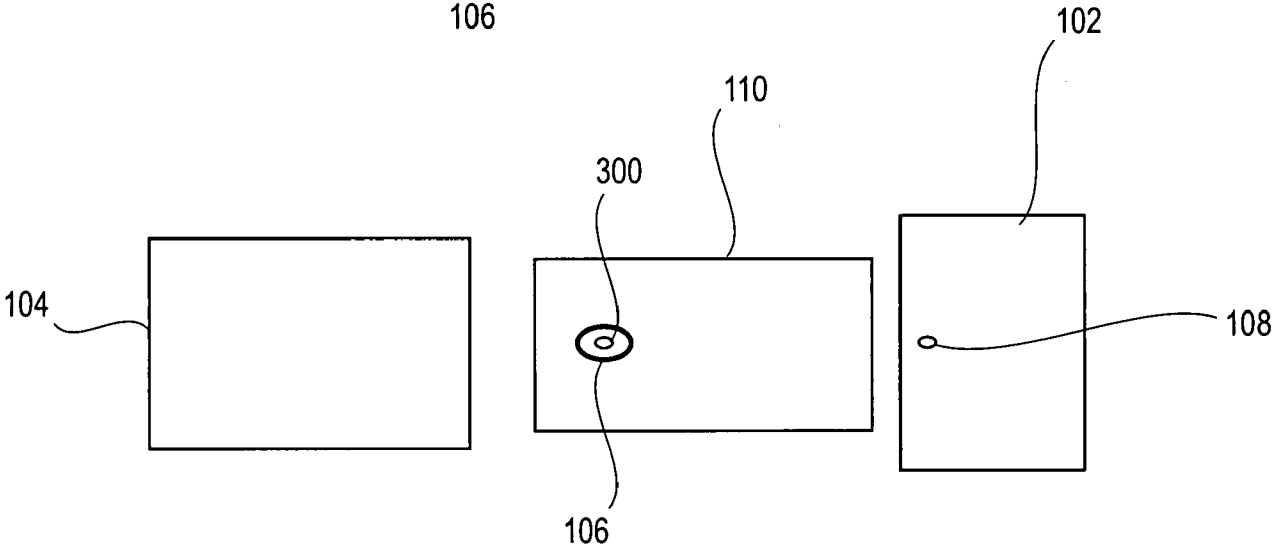
FIG. 9 is a top view of the bottom portion of the MEMS switch shown in FIG. 8.

Referring to FIG. 8, stopper bumps 300 may also be added near the backside of the lower electrostatic actuation plates in order to prevent shorts due to other types of deformations in the upper beam 106. In this case and as shown in FIG. 9, the isolation groove 302 surrounds the stopper bump 300 to prevent an electrical short should the upper actuation plate 111 make contact with the stopper bump 300.

The above description of illustrated embodiments of the invention, including what is described in the Abstract, is not intended to be exhaustive or to limit the invention to the precise forms disclosed. While specific embodiments of, and examples for, the invention are described herein for illustrative purposes, various equivalent modifications are possible within the scope of the invention, as those skilled in the relevant art will recognize.

These modifications can be made to the invention in light of the above detailed description. The terms used in the following claims should not be construed to limit the invention to the specific embodiments disclosed in the specification and the claims. Rather, the scope of the invention is to be determined entirely by the following claims, which are to be construed in accordance with established doctrines of claim interpretation.

What is claimed is:

1. A Micro Electro-Mechanical System (MEMS) switch, comprising:

a beam cantilevered over a substrate; an upper actuation plate associated with said beam;

a lower actuation plate beneath said upper actuation plate on said substrate;

a contact bump on said substrate to make contact with an end of said beam;

at least one stopper bump on said substrate within the lower actuation plate; and an isolation groove formed in the lower actuation plate surrounding said at least one stopper bump.

2. The MEMS switch as recited in claim 1, further comprising:

a first stopper bump in a first corner of said lower actuation plate; and a second stopper bump in a second corner of said lower actuation plate.

3. The MEMS switch as recited in claim 2 further comprising:

one stopper bump near a rear of said lower actuation plate.

4. The MEMS switch as recited in claim 1 wherein said at least one stopper bump comprises an oxide.

5. The MEMS switch as recited in claim 1 wherein said contact bump has a greater height than said at least one stopper bump.

6. The MEMS switch as recited in claim 5 wherein a height of said at least one stopper bump is related to the width of said at least one stopper bump.

7. A method for preventing torque shorts in a Micro Electro-Mechanical System (MEMS) switch, comprising:

positioning an upper actuation plate on a cantilevered beam;

actuating a lower actuation plate beneath said upper actuation plate to pull a tip of said beam onto contact with a contact bump;

positioning at least one stopper bump on said lower actuation plate to prevent said upper actuation plate from shorting with said lower actuation plate; and forming an isolation groove in the lower actuation plate surrounding said stopper bump.

8. The method as recited in claim 7, further comprising:

making said stopper bump with a field oxide (FOX).

9. The method as recited in claim 7 further comprising:

positioning two stopper bumps in corners of said lower actuation plate.

10. The method as recited in claim 7 further comprising:

positioning said stopper bump near a rear of said lower actuation plate.

11. The method as recited in claim 7 wherein said contact bump and said at least one stopper bump as made with a same mask.

12. The method as recited in claim 7 wherein a height of said stopper bump is determined by a diameter of said contact bump.

13. A Micro Electro-Mechanical System (MEMS) switch system, comprising:

a beam cantilevered over a substrate connected to an input signal line;

an upper actuation plate associated with said beam;

a lower actuation plate beneath said upper actuation plate on said substrate;

a contact bump on said substrate connected to an output signal line, to make contact with an end of said beam when said upper actuation plate is energized;

at least one stopper bump on said substrate within the lower actuation plate; and an isolation groove formed in the lower actuation plate surrounding said at least one stopper bump.

14. The system as recited in claim 13, further comprising:

a first stopper bump in a first comer of said lower actuation plate; and a second stopper bump in a second corner of said lower actuation plate.

15. The system as recited in claim 13 further comprising:

a stopper bump near a rear of said lower actuation plate.

16. The system as recited in claim 13, wherein said contact bump comprises a greater height than said stopper bump.

17. The system as recited in claim 16 wherein a height of said stopper bump is determined by a diameter of said stopper bump.

* * * * *